US005534089A

United States Patent [19]

Fujinaga et al.

[11] Patent Number: 5,534,089

[45] Date of Patent: Jul. 9, 1996

[54] METHOD OF MANUFACTURING SMALL PLANAR ANISOTROPIC HIGH-STRENGTH THIN CAN STEEL PLATE

[75] Inventors: Chikako Fujinaga; Akio Tosaka; Toshiyuki Kato; Kaku Sato, all of Chiba, Japan

[73] Assignee: Kawasaki Steel Corporation, Kobe, Japan

[21] Appl. No.: 360,250

[22] Filed: Dec. 20, 1994

[30] Foreign Application Priority Data

Dec. 21, 1993 [JP] Japan ..... 5-322410

[51] Int. Cl.[6] ..... C21D 8/02

[52] U.S. Cl. ..... 148/603; 148/651; 148/654

[58] Field of Search ..... 148/603, 653, 148/654, 651

[56] References Cited

FOREIGN PATENT DOCUMENTS 0556834 8/1992 European Pat. Off. ..... 148/603

405171287 7/1993 Japan ..... 148/603

*Primary Examiner*—Deborah Yee

*Attorney, Agent, or Firm*—Dvorak and Traub

[57] ABSTRACT

A method of manufacturing a small planar anisotropic high-strength can steel plate. Hot-rolling is first performed on a steel slab at an $Ar_3$ transformation point or higher to obtain hot rolled steel strip. The slab has a composition which essentially consists of and which satisfies the conditions of: C≦0.004%, Si≦0.02%, Mn=0.5%–3%, P≦0.02%, Al=0.02%–0.05%, 0.008%≦N≦0.024%, and the rest being Fe and unavoidable impurities, wherein the conditions have the relationship of:Al%/N%>2. Then, the resultant strip is cooled at a cooling rate of 10° C./s or higher so as to reach a temperature of 650° C. or lower. The resultant strip is further coiled at a temperature in a range of from 550° C. to 400° C. Cold-rolling is performed on the resultant strip at a reduction ratio of 82% or higher preceded by removing a scale to obtain cold rolled steel strip. Subsequently, continuous annealing is performed on the resultant cold rolled steel strip at a recrystallization temperature or higher, being followed by temper-rolling.

11 Claims, No Drawings

METHOD OF MANUFACTURING SMALL PLANAR ANISOTROPIC HIGH-STRENGTH THIN CAN STEEL PLATE

BACKGROUND OF THE INVENTION

1. Field of the Invention

The present invention relates to a method of manufacturing thin can steel plate used for a tinplate, tin-free steel, and the like. More particularly, the invention relates to a method of manufacturing a higher-strength can steel plate having a smaller thickness and better workability compared to conventional can steel plates.

2. Description of the Related Art

Can steel plates, in particular, beverage can steel plates, are becoming thinner with a view to saving resources and achieving weight reduction. Improvements are being made to make the can steel plates thinner-walled. There is also a demand for good workability in the application of such steel plates to two-piece cans.

Conventionally, for example, a box-annealing material having a thickness of approximately 0.33 mm or greater and a tempering degree of approximately T1 (a strength (TS) of from approximately 32 to 33 kgf/mm$^2$) is used for DI two-piece cans. The thickness of such a material has recently been gaged down to 0.29 mm and even to 0.25 mm or smaller. Along with the downsizing of the material, there follows an increase in the use of high-strength materials having a tempering degree of T2.5 (a strength TS of approximately 37 kgf/mm$^2$), and high-strength materials even having a tempering degree of from T3 to T4 (a strength TS of from approximately 38 to 39 kgf/mm$^2$).

Further, since deep drawing is performed on the two-piece cans in the manufacturing process, there is a demand for a large degree of average r and a small degree of $\Delta r$. For example, there is a demand that a DI can steel plate should have an average r of 1.3 or greater and $\Delta r$ of 0.3 or smaller. A small degree of $\Delta r$ is demanded with a view to suppress earing during deep drawing for improving yield of produced can and to avoid breaking the earing during ironing performed on the coarse form of the can and during a subsequent process of removing the can from a punch.

Although many proposals have been made for a method of manufacturing a can steel plate, no proposal meets all the requirements described above.

For example, Japanese Patent Laid-Open No. 2-118027 discloses a method of manufacturing a can steel plate having good workability. This method is employed whereby the so-called extremely-low carbon steel slab having a predetermined composition is subjected to hot rolling, cold rolling, and acid pickling according to a conventional procedure, being followed by cold rolling under a rolling reduction ratio of from 85 to 90% to obtain hot rolled steel strip. Subsequently, the resultant strip is subjected to continuous annealing and further to temper rolling under a rolling reduction ratio of from 15 to 45%, thereby strengthening the steel.

However, the foregoing method presents the following problems. Since extremely-low carbon steel is used as a material, it is necessary to perform temper rolling under a considerably high reduction ratio, subsequent to the continuous annealing, in order to obtain a high-strength steel plate. This lowers productivity.

A proposal which was made to increase the strength of a can steel plate is disclosed in, for example, Japanese Patent Laid-Open No. 2-118025. Under this method N is added to the material of a steel, and the temper rolling is further performed after annealing, thereby increasing the strength of the steel.

However, the steel plate obtained by this method cannot meet the conditions of good workability and having a small planar anisotropy ($\Delta r$), which are required for manufacturing a two-piece can having a large reduction ratio.

A method of utilizing texture controlling technique by precipitating AlN during annealing is well known as a method of ensuring good workability. However, this method presents the following problems. Since AlN is precipitated during annealing, a comparatively slow heating speed is required. This typically necessitates the employment of a box-annealing process, and thus it is very unlikely to be able to provide a cost-effective continuous annealing method.

Further, Japanese Patent Laid-Open No. 63-230848 discloses a method of manufacturing a steel plate having good workability through the use of texture controlling technique by means of the precipitation of AlN during the continuous annealing process. This method is employed as follows. A steel having a composition of C≦0.003%, Mn=0.09–0.8%, sol.Al=0.06–0.12%, and N=0.005–0.011% is used. It is subjected to hot rolling and is then coiled at a temperature of 560° C. or lower. Subsequently, it is subjected to cold rolling and is continuously annealed under the conditions of an average temperature rise speed of from 1° to 20° C./s in a range of from 400° to 700° C. and a maximum heating temperature of from 700° to 900° C. This process is intended to ensure good workability.

However, this method requires the content of a large amount of Al as much as 0.06% or higher. This promotes the precipitation of AlN during hot rolling, and the amount of precipitated AlN varies, making it difficult to control the amount of dissolved N, prior to continuous annealing. This further makes it difficult to control the amount of AlN which should be precipitated in the process of continuous annealing, thereby making a variation in the material quality wider. Additionally, a large amount of Al content makes the product expensive.

SUMMARY OF THE INVENTION

Accordingly, an object of the present invention is to provide a method of manufacturing a high-strength thin can steel plate having good workability.

Another object of the present invention is to provide a method of manufacturing a can steel plate provided with the foregoing characteristics achieved through a continuous annealing process.

A further object of the present invention is to provide a manufacturing method whereby the reduction ratio of temper rolling subsequent to continuous annealing is sufficient in terms of a reduction ratio of from 1 to 3%, that is employed in a conventional method.

The specific product characteristics according to the present invention should meet all the requirements of: a thickness of 0.29 mm or smaller, and more preferably, 0.25 mm or smaller; a strength (TS) level of 37 kgf/mm$^2$ or more, and more preferably, 39 kgf/mm$^2$ or more, when the temper rolling reduction ratio is from 1 to 3%; an average value r of 1.3 or greater; and planar anisotropy of $\Delta r$ of 0.3 or lower, and more preferably, 0.2 or lower.

The $\Delta r$ indicating planar anisotropy can be expressed by the following equation:

$$\Delta r=(r_L+rC-2rD)/2$$

wherein $r_L$: the value r in the rolling direction, $r_C$: the value r at 90° with respect to the rolling direction, and $r_D$: the value r at 45° with respect to the rolling direction.

In order to solve the foregoing problems, the present inventors made various investigations and examinations. They discovered that a can steel plate having the targeted characteristics can be manufactured by a continuous annealing process which uses as a material extremely-low carbon steel containing large amounts of Mn and N and which makes adjustments to hot rolling conditions.

Accordingly, in order to achieve the foregoing objects, the present invention provides a method of manufacturing a can steel plate having a small planar anisotropy as well as high strength, comprising the steps of: hot-rolling a steel slab to produce a hot rolled steel strip at an $Ar_3$ transformation point or higher, the slab having a composition which essentially consists of and which satisfies the conditions of: C≦0.004%, Si≦0.02%, Mn=0.5%–3%, P≦0.02%, Al=0.02%–0.05%, 0.008%≦N≦0.024%, and the rest being Fe and unavoidable impurities, wherein the conditions have the relationship of:Al%/N%>2; cooling the resultant hot rolled steel strip at a cooling rate of 10° C./s or higher so as to reach a temperature of 650° C. or lower; coiling the resultant hot rolled steel strip at a temperature in a range of from 550° C. to 400° C.; cold-rolling the resultant hot rolled steel strip at a reduction ratio of 82% or higher to produce a cold rolled steel strip after removing a scale; continuously annealing the resultant cold rolled steel strip at a recrystallization temperature or higher; and temper-rolling the resultant cold rolled steel strip.

The more specific features, the conditions for carrying out the present invention, and the like, will be apparent from the following description in the embodiment and the appended claims.

DESCRIPTION OF THE PREFERRED EMBODIMENT

Conditions for Material Composition

A description will first be given of the composition of the material.

C: It is necessary to maintain the C content in the material in a low level in order to ensure good workability. It is also necessary that the C content should be 0.004% or lower in order to perform texture controlling by means of the precipitation of AlN during the continuous annealing. However, C content 0.0003% or lower may make the crystal grain size be significantly coarsened, thereby resulting in surface roughening of the resultant steel plate after press-working. The lower limit of the C content thus should be 0.0003%.

Si: Si is used for strengthening the steel, but it brings about decreases in workability and in corrosion resistance, and accordingly, the Si content is desirably lowered as much as possible. The upper limit of the Si content should be 0.02%.

Mn: Mn is typically an essential element for strengthening a steel plate, and can thus be actively added to strengthen the extremely-low carbon steel in this embodiment.

The important factors for Mn are not limited to the foregoing factors peculiar to the typical properties of Mn. Although the detailed mechanism of Mn is unknown, a predetermined amount of Mn is inevitable in order to inhibit the precipitation of N and to ensure the amount of dissolved N prior to the continuous annealing, which properties of N may be related to a reduction in the transformation point during hot rolling. Mn also has the advantage of promoting the precipitation of AlN during the continuous annealing.

Thus, the present invention can be summarized as follows. Extremely-low carbon is used as a material and predetermined amounts of Mn, N and Al are added to the carbon. The hot rolling conditions and continuous annealing conditions are suitably adjusted as described below, thus enhancing the precipitation of AlN during the continuous annealing, thereby bringing about an improvement in the texture controlling. This further gives rise to an improvement in plane anisotropic characteristics of the value r.

In order to obtain the foregoing advantages, it is necessary to add 0.5% or higher Mn in the present invention. However, the Mn content in excess of 3% significantly hardens the hot-rolled steel strip, which makes it difficult to perform cold rolling on the resultant strip. Accordingly, the Mn content should be restricted to a range of from 0.5 to 3%.

P: P, as well as Si, is an element for strengthening steel. At the same time, however, it also brings about decreases in workability and corrosion resistance, and accordingly, the P content is desirably lowered as much as possible. The upper limit of the P content should be 0.02%.

Al: Al is an essential element required for precipitating N as AlN. It is necessary to add 0.02% or higher Al in order to exert the effect of facilitating the precipitation of N during the continuous annealing. However, an excessive amount of Al overly accelerates the precipitation of AlN during hot rolling, thus hampering texture controlling by means of the precipitation of AlN during the continuous annealing and inhibiting an increase in strength. An excessive amount of Al and excessive disparity of thermal hysterisis of hot rolled steel strip cause a large variation in precipitation quantity of AlN in the hot rolled steel strip, thus causing a variation in the material quality. Accordingly, the upper limit of the Al content should be 0.05%, and more preferably, 0.04% or lower. It is also necessary in the present invention that N be precipitated as AlN substantially completely during the continuous annealing. In order to meet such a requirement, there is a demand for the condition that Al%/N%>2.

N: N is an important element for performing texture control in the present invention. A large amount of N should be added with a view to precipitating a large amount of finely-formed AlN during the continuous annealing so as to perform the texture control function and also to increase the strength of the resultant steel plate. A small amount of the N content delays the precipitation of AlN during annealing, thereby inhibiting the effect of texture control and making the dissolved N more likely to remain.

Accordingly, the N content is determined to be 0.008% or higher in the present invention. A large amount of N is preferably added, but the amount in excess of 0.024% or higher saturates the effects of N and also increases the danger of producing defects during the continuous casting. The upper limit is thus restricted to 0.024%.

The basic conditions for the material in the present invention have thus been discussed as described above. Although a large amount of N, among other elements, should be added, it is substantially precipitated as AlN under the presence of the foregoing Mn and Al thus it is free from the problem of ageing caused by N.

In the present invention, since a large amount of extremely fine AlN is present in the steel. This results in many portions at which dislocation is likely to occur, thereby inhibiting an occurrence of yield point elongation, or the like, compared with typical extremely-low carbon steel containing a small amount of AlN.

For the applications which are particularly influenced by the ageing, the C content in the steel is lowered so that ageing characteristics can be improved. In order to achieve this, the C content in the steel should be 0.0010% or lower. If it is difficult to reduce the C content in the steel to an extent of a range within which ageing does not present any problem, ageing characteristics can be improved by adding Nb to reduce the amount of dissolved C, which causes the ageing.

In such a case, Nb should be added to such an extent as to meet the condition of the expression: $C\%-0.0010\% \leqq Nb\% \times 12/93$. However, a large amount of Nb in excess of 0.04% increases the recrystallization temperature during the continuous annealing, thus making the annealing conditions more demanding and also disadvantageously making Nb fix N, thereby hampering the precipitation of AlN. Consequently, the lower limit of the Nb content should be a value calculated by the expression: $C\%-0.0010\% \leqq Nb\% \times 12/93$, while the upper limit should be 0.04%.

For evaluating ageing characteristics as baked hardness (BH), the condition of the expression: $BH \leqq 1$ kgf/mm$^2$ should be satisfied, thereby eliminating the problem of ageing characteristics.

Rolling and Annealing Conditions

A description will now be given of the reasons for restricting the rolling conditions.

Hot rolling and cold rolling can be performed according to a conventional procedure, but the below-mentioned conditions should be met in such a procedure.

The hot rolling finishing temperature: the rolling finishing temperature should be the $Ar_3$ transformation point or higher. If the rolling is performed on the ferrite area of the steel plate at a finishing temperature below the $Ar_3$ transformation point, the precipitation of AlN is accelerated in the hot rolled-plate. This makes it difficult to perform the texture control step by means of the precipitation of AlN during annealing.

Even if the rolling finishing temperature is the $Ar_3$ transformation point or higher, the addition of Nb disadvantageously fixes N during hot rolling, which decreases the amount of dissolved N prior to annealing and also restricts the effect of reducing the ageing amount, which effect can be achieved by the addition of Nb. Thus, the rolling finishing temperature is preferably at 870° C. or higher if Nb is added.

In contrast, a high rolling finishing temperature as high as 980° C. or higher undesirably coarsens the crystal grain size of the hot rolled-plate and is likely to reduce the value r. Thus, the rolling finishing temperature is also preferably at 980° C. or lower.

Coiling temperature: the upper limit of the coiling temperature should be 550° C. The coiling temperature in excess of 550° C. widens a variation in the material quality in the longitudinal direction of the strip. This necessities an increase in the amount of cutting of the forward and rear ends of the product in order to ensure the uniformity of the material quality of the product, thereby deteriorating the yield of the product. A higher coiling temperature also induces the precipitation of AlN in the coarse form in the hot rolled-plate, thereby decreasing the contribution to the texture control step during the continuous annealing and to an increase in the strength.

A coiling temperature below 400° C. may change or disorder the configuration of the plate which has been coiled in a currently-available hot rolling device, thus hampering subsequent processes of acid pickling and cold rolling. The lower limit of the coiling temperature should thus be 400° C.

Cooling rate: the cooling rate after the finish-rolling so as to reach 650° C. is determined to be 10° C./s, and more preferably, 20° C./s or higher. In terms of inhibiting the precipitation of AlN in the hot rolled-plate, it is necessary to maximize the cooling rate in a range from a temperature at which the rolling is completed to 650° C. at which AlN is likely to be precipitated. A low cooling rate facilitates the precipitation of AlN during cooling or the formation of a precipitated nucleus of AlN even if a Mn-contained material is used so that N is unlikely to be precipitated in the hot-rolled plate. This promotes the precipitation of AlN in the hot-rolled plate and thus fails to benefit from adding N.

In the present invention, it is possible to allow a large amount of dissolved N to remain prior to annealing by making adjustments to the cooling rate. The dissolved N is precipitated as finely-formed AlN during the continuous annealing, thus enabling the recrystallization texture controlling without adding a large amount of Al thereby achieving good workability and, in particular, an improvement in Rankford value r.

Cold rolling conditions: the steel plate subjected to hot rolling undergoes acid pickling and cold rolling, being followed by the continuous annealing at a recrystallization temperature or higher.

In the present invention, since the steel plate subjected to hot rolling is coiled at a low temperature, very good acid pickling properties can be obtained. Also, the cold rolling reduction ratio is 82% or higher, and more preferably, 86% or higher, in order to obtain good deep drawing workability and also to facilitate the precipitation of AlN during the continuous annealing.

Continuous annealing: the annealing temperature should be the recrystallization temperature or higher because it is necessary to recrystallize the steel plate during annealing. It is also preferable that the steel plate be annealed at a relatively high temperature as high as 720° C. or higher in order to completely precipitate AlN in the fine form during annealing. However, an excessively high annealing temperature increases the danger of producing defects during the continuous annealing, such as heat buckling, plate breaking, and the like. The annealing temperature is thus preferably 840° C. or lower. The heating speed of the continuous annealing in a range of approximately 1° to 100° C./s exerts a very little influence on the resultant steel plate, and accordingly, stable material quality can be guaranteed.

Temper-rolling: temper-rolling is performed on the steel plate which has been subjected to annealing. Yield point elongation occurs in the steel plate subjected only to annealing without performing a further process, thereby making the material quality unstable. Accordingly, it is necessary to perform temper-rolling on the steel plate at a reduction ratio of 1% or higher. In the present invention, adjustments are made to the composition, and the hot rolling and cold rolling conditions, thereby realizing a high-strength can steel plate having a small thickness and achieving good workability. Thus, it is intrinsically sufficient to perform temper-rolling to such an extent as to adjust the configuration of the steel plate, that is, a rolling reduction ratio approximately from 1 to 3%.

However, temper-rolling at a higher reduction ratio of 5% or higher enhances strength. Temper-rolling at a high reduction ratio is likely to reduce the baked hardness BH and also enables an improvement in the ageing characteristics. However, a reduction ratio in excess of 40% results in hardening the steel plate making it difficult to perform cold rolling and also results in visualizing the disorder of the configuration of the steel plate. The reduction ratio of temper-rolling is thus preferably approximately from 1 to 40%.

The present invention achieves texture control by means of the precipitation of AlN although continuous annealing is employed. This results for the following reasons. Since extremely-low carbon steel is used as a material, there are less portions where the recrystallization is started, such as carbides, thereby exerting a considerable influence on the recrystallization of AlN. Further, the achievement of texture control by means of the precipitation of AlN without adding a large amount of Al may result from the fact that a large amount of dissolved N can be guaranteed prior to annealing by making adjustments to the composition and the rolling conditions and that the precipitation of AlN during the continuous annealing is promoted due to the addition of Mn and due to a comparatively high cold-rolling reduction ratio, and other reasons.

Still further, in the present invention, the precipitation of the finely-formed AlN during annealing is further consolidated, thereby enhancing an increase in the strength of the steel plate. This results in the achievement of the high-strength steel plate although extremely-low carbon steel is used as a material.

EXAMPLE

A steel from a converter and which had a composition shown in Table 1 (the rest was Fe and unavoidable impurities) was continuously cast into slab and thus produced slab was subjected to hot rolling into hot rolled strip. The hot rolled steel strip was then pickled and cold rolled into cold rolled steel strip. The cold rolled steel strip was then continuously annealed at an average heating rate of from 20° to 30° C./s in a temperature range of from 740° to 800° C., being followed by temper-rolling, under the conditions shown in Table 2. A tinplating was performed on the resultant cold rolled strip by a halogen-type electro-tinplating line so as to finish the strip as a tin plate having a #25 quality. Evaluations were made for the tensile strength (TS), the average value r, the planar anisotropy value Δr, and BH characteristics of the resultant tin plate. The results are shown in Table 2.

As is seen from Table 1 (material composition), Table 2 (rolling and annealing conditions) and Table 3 (product characteristics), the steel plate manufactured according to the present invention achieved small anisotropic characteristics in r and high strength, which overall properties were desirable used for a thin can steel plate. Also, the reduction ratio of temper-rolling subsequent to the continuous annealing was increased so as to further enhance the strength of the steel plate. Further, it was verified that a decrease in the C content or the addition of a suitable amount of Nb enabled a reduction in the baked hardness BH as much as 1 kgf/mm$^2$ or lower, thereby significantly improving the ageing characteristics.

Subsequent to tinplating, a reflow process (tin-melting process) was continuously performed on a sample of this example so as to finish the sample as a tin plate. Painting and baking were then performed on the tin plate, being followed by a welding test and flange working. Then, evaluations were made for the presence of cracking of the HAZ portion. There was no problem of welding characteristics and workability achieved subsequent to the welding process, exhibiting good results in producing three-piece welded can.

Although in this example the steel was finished as a tinplated steel plate, it may be used as a can steel plate, such as a tin-free steel plate or a composite plated steel plate, or the like, in which case good characteristics can also be obtained.

As will be clearly understood from the foregoing description, the present invention offers the following advantages.

It is possible to reliably and cost-effectively provide a high-strength can steel plate having a small thickness and having small planar anisotropy in the value r, which properties have not been obtained by the conventional steel plates so far, thereby remarkably exhibiting the contributions to productivity, cost efficiency and weight reduction for the use of cans, and in particular, DI cans.

TABLE 1

| STEEL | CHEMICAL COMPOSITION (wt %) | | | | | | | | C % — | |
|---|---|---|---|---|---|---|---|---|---|---|
| NO. | C | Bi | Mn | P | S | Al | N | Nb | (Nb % × 12/93) | STEEL |
| 1 | 0.002 | 0.009 | 0.55 | 0.01 | 0.009 | 0.04 | 0.011 | 0 | — | Steel of |
| 2 | 0.0032 | 0.01 | 0.71 | 0.011 | 0.007 | 0.032 | 0.01 | 0 | — | the present |
| 3 | 0.003 | 0.009 | 0.8 | 0.01 | 0.01 | 0.035 | 0.012 | 0 | — | Invention |
| 4 | 0.003 | 0.009 | 0.8 | 0.01 | 0.01 | 0.035 | 0.012 | 0 | — | |
| 5 | 0.003 | 0.009 | 0.8 | 0.01 | 0.01 | 0.035 | 0.012 | 0 | — | |
| 6 | 0.0038 | 0.01 | 2.2 | 0.012 | 0.01 | 0.028 | 0.009 | 0 | — | |
| 7 | 0.0023 | 0.01 | 1.5 | 0.01 | 0.008 | 0.043 | 0.015 | 0 | — | |
| 8 | 0.0016 | 0.01 | 0.63 | 0.01 | 0.008 | 0.04 | 0.012 | 0 | — | |
| 9 | 0.0008 | 0.01 | 0.95 | 0.008 | 0.01 | 0.04 | 0.012 | 0 | — | |
| 10 | 0.0005 | 0.01 | 1.20 | 0.009 | 0.01 | 0.043 | 0.011 | 0 | — | |
| 11 | 0.0021 | 0.01 | 0.7 | 0.009 | 0.007 | 0.038 | 0.01 | 0.013 | 0.0004 | |
| 12 | 0.0025 | 0.009 | 0.6 | 0.01 | 0.009 | 0.04 | 0.015 | 0.014 | 0.0007 | |
| 13 | 0.0018 | 0.01 | 1.85 | 0.007 | 0.01 | 0.028 | 0.012 | 0.016 | −0.0003 | |
| 14 | 0.0015 | 0.01 | 0.7 | 0.01 | 0.01 | 0.04 | 0.013 | 0.024 | −0.0016 | |
| 15 | 0.0013 | 0.01 | 0.65 | 0.011 | 0.008 | 0.042 | 0.01 | 0.007 | 0.0004 | |
| 16 | 0.01 | 0.008 | 0.65 | 0.01 | 0.009 | 0.04 | 0.01 | 0 | — | Steel in |
| 17 | 0.002 | 0.01 | 0.2 | 0.01 | 0.01 | 0.04 | 0.014 | 0 | — | the |
| 18 | 0.0021 | 0.01 | 0.6 | 0.01 | 0.009 | 0.08 | 0.01 | 0 | — | comparative |
| 19 | 0.002 | 0.01 | 0.6 | 0.01 | 0.01 | 0.04 | 0.004 | 0 | — | example |
| 20 | 0.0023 | 0.01 | 0.6 | 0.01 | 0.01 | 0.04 | 0.011 | 0 | — | |
| 21 | 0.0022 | 0.01 | 0.6 | 0.008 | 0.01 | 0.042 | 0.012 | 0 | — | |
| 22 | 0.0025 | 0.01 | 0.65 | 0.01 | 0.009 | 0.038 | 0.01 | 0 | — | |
| 23 | 0.002 | 0.01 | 0.55 | 0.01 | 0.008 | 0.042 | 0.005 | 0.011 | 0.0006 | |
| 24 | 0.003 | 0.009 | 0.7 | 0.01 | 0.01 | 0.03 | 0.012 | 0.006 | 0.0022 | |
| 25 | 0.0021 | 0.01 | 0.7 | 0.009 | 0.007 | 0.045 | 0.01 | 0.013 | 0.0004 | |

TABLE 2

| STEEL NO. | HOT-ROLLING FINISHING TEMPERATURE (C.°) | COILING TEMPERATURE (°C.) | COOLING RATE TO 650° C. AFTER HOT ROLLING | COLD-ROLLING REDUCTION RATE (%) | TEMPER ROLLING REDUCTION RATE (%) | STEEL |
|---|---|---|---|---|---|---|
| 1 | 890 | 500 | 20 | 89 | 1.2 | Steel of the present invention |
| 2 | 870 | 530 | 14 | 87 | 2 | |
| 3 | 880 | 520 | 25 | 89 | 1.5 | |
| 4 | 890 | 520 | 20 | 88 | 10 | |
| 5 | 890 | 520 | 25 | 88 | 30 | |
| 6 | 870 | 450 | 37 | 90 | 1.3 | |
| 7 | 910 | 510 | 21 | 89 | 1.3 | |
| 8 | 880 | 490 | 20 | 84 | 1.5 | |
| 9 | 880 | 480 | 40 | 91 | 1.1 | |
| 10 | 870 | 500 | 32 | 86 | 1.5 | |
| 11 | 870 | 500 | 25 | 89 | 1.5 | |
| 12 | 880 | 500 | 25 | 88 | 1.5 | |
| 13 | 880 | 510 | 21 | 87 | 1.5 | |
| 14 | 890 | 450 | 28 | 87 | 20 | |
| 15 | 890 | 530 | 13 | 93 | 1.2 | |
| 16 | 880 | 500 | 20 | 87 | 1.5 | Steel in the comparative example |
| 17 | 880 | 500 | 20 | 89 | 1.5 | |
| 18 | 890 | 520 | 23 | 87 | 1.5 | |
| 19 | 880 | 500 | 20 | 89 | 1.5 | |
| 20 | 880 | 590 | 12 | 89 | 1.5 | |
| 21 | 890 | 500 | 5 | 88 | 1.5 | |
| 22 | 880 | 510 | 20 | 75 | 1.5 | |
| 23 | 890 | 500 | 20 | 89 | 1.5 | |
| 24 | 890 | 530 | 21 | 89 | 1.5 | |
| 25 | 880 | 520 | 4 | 89 | 1.5 | |

TABLE 3

| STEEL NO. | TS (kgf/mm$^2$) | MEAN r VALUE | Δ r | BH (kgf/mm$^2$) | |
|---|---|---|---|---|---|
| 1 | 38.0 | 1.7 | 0.05 | 4 | Steel of the present invention |
| 2 | 39.0 | 1.6 | 0.2 | 5 | |
| 3 | 39.0 | 1.6 | 0.1 | 5 | |
| 4 | 44.0 | 1.5 | 0.1 | 0.9 | |
| 5 | 58.0 | 1.5 | 0.1 | 0.5 | |
| 6 | 43.0 | 1.5 | 0.1 | 5 | |
| 7 | 41.0 | 1.6 | 0.1 | 3 | |
| 8 | 37.0 | 1.5 | 0.2 | 4 | |
| 9 | 38.0 | 1.7 | 0.1 | 0.9 | |
| 10 | 37.0 | 1.7 | 0.1 | 0.1 | |
| 11 | 37.0 | 1.6 | 0.1 | 0.1 | |
| 12 | 40.0 | 1.7 | 0.1 | 0.8 | |
| 13 | 41.0 | 1.6 | 0.1 | 0 | |
| 14 | 54.0 | 1.6 | 0 | 0 | |
| 15 | 38.0 | 1.5 | 0.2 | 0.5 | |
| 16 | 41.0 | 1 | −0.6 | 6 | Steel in the comparative example |
| 17 | 33.5 | 1.2 | −0.4 | 4 | |
| 18 | 32.0 | 1.4 | 0.4 | 3 | |
| 19 | 35.0 | 1.2 | −0.5 | 4 | |
| 20 | 35.0 | 1.2 | −0.5 | 4 | |
| 21 | 35.0 | 1.2 | −0.5 | 4 | |
| 22 | 32.0 | 1.2 | 0.6 | 4 | |
| 23 | 36.0 | 1.2 | −0.4 | 3 | |
| 24 | 39.0 | 1.5 | 0.2 | 5 | |
| 25 | 35.5 | 1.3 | −0.5 | 3 | |

What is claimed is:

1. A method of manufacturing a high-strength can steel plate having small ageing and small planar anisotropic characteristics, comprising the steps of:

hot-rolling a steel slab to obtain a hot rolled steel strip at a hot rolled finished temperature of at least an $Ar_3$ transformation point said slab having a composition which is essentially comprised of and which satisfies the conditions of: C≦0.004%, Si≦0.02%, Mn=0.5%–3%, P≦0.02%, Al=0.02%–0.05%, 0.008%≦N≦0.024%, with the remainder being Fe and other unavoidable impurities, wherein said conditions have the relationship of:Al%/N%>2;

cooling the resultant hot rolled steel strip at a cooling rate of at least 10° C./s so as to at least cool said strip to a temperature of 650° C.

coiling the resultant strip at a temperature in a temperature range from 550° C. to 400° C.;

cold-rolling the resultant strip at a reduction ratio of at least 82%, preceded by removing a scale to obtain cold rolled steel strip;

continuously annealing the resultant cold rolled steel strip at least at a recrystallization temperature and temper-rolling the resultant cold rolled steel strip.

2. A method of manufacturing the high-strength can steel plate having small ageing and small planar anisotropic characteristics according to claim 1, wherein said steel slab further contains Nb under the conditions of: Nb≦0.04% wherein Al%/N%>2 and C%–0.0010≦(Nb%×12/93).

3. A method of manufacturing the high-strength can steel plate having small ageing and small planar anisotropic characteristics according to claim 1, wherein the C content of said steel slab is at most 0.0010%.

4. A method of manufacturing the high-strength can steel plate having small ageing and small planar anisotropic characteristics according to claim 2, wherein the hot rolled finished temperature is at least 870° C.

5. A method of manufacturing the high-strength can steel plate having small ageing and small planar anisotropic characteristics according to claim 1, wherein the cooling rate after hot rolling is at least 20° C./s.

6. A method of manufacturing the high-strength can steel plate having small ageing and small planar anisotropic characteristics according to claim 1, wherein the reduction ratio of the cold rolling subsequent to the removing of the scale is at least 86%.

7. A method of manufacturing the high-strength can steel plate having small ageing and small planar anisotropic characteristics according to claim 1, wherein a reduction ratio of the temper rolling performed subsequent to the continuous annealing is from 1 to 3%.

8. A method of manufacturing the high-strength can steel plate having small ageing and small planar anisotropic characteristics according to claim 1, wherein the reduction ratio of the temper rolling performed subsequent to the continuous annealing is at least 5%.

9. A method of manufacturing the high-strength can steel plate having small ageing and small planar anisotropic characteristics according to claim 2, wherein the reduction ratio of the cold rolling subsequent to the removing of the scale is at least 86%.

10. A method of manufacturing the high-strength can steel plate having small ageing and small planar anisotropic characteristics according to claim 2, wherein the reduction ratio of the temper rolling performed subsequent to the continuous annealing is from 1 to 3%.

11. A method of manufacturing the high-strength can steel plate having small ageing and small planar anisotropic characteristics according to claim 2, wherein the reduction ratio of the temper rolling performed subsequent to the continuous annealing is at least 5%.

* * * * *